US008342425B2

(12) United States Patent
Imoehl

(10) Patent No.: US 8,342,425 B2
(45) Date of Patent: Jan. 1, 2013

(54) MULTI-POINT LOW PRESSURE INDUCTIVELY HEATED FUEL INJECTOR WITH HEAT EXCHANGER

(75) Inventor: William J. Imoehl, Williamsburg, VA (US)

(73) Assignee: Continental Automotive Systems US, Inc., Aubrun Hills, MI (US)

( * ) Notice: Subject to any disclaimer, the term of this patent is extended or adjusted under 35 U.S.C. 154(b) by 338 days.

(21) Appl. No.: 12/314,063

(22) Filed: Dec. 3, 2008

(65) Prior Publication Data

US 2010/0133363 A1 Jun. 3, 2010

(51) Int. Cl.

| | |
|---|---|
| ***B05B 1/24*** | (2006.01) |
| ***B05C 1/00*** | (2006.01) |
| *B05B 1/34* | (2006.01) |
| *F02M 59/00* | (2006.01) |
| *F02M 63/00* | (2006.01) |

(52) U.S. Cl. ..... 239/135; 239/133; 239/136; 239/533.2; 239/585.1; 239/585.5

(58) Field of Classification Search ..... 239/135, 239/88–92, 533.2–533.15, 585.1–585.5; 123/557, 41.31, 472

See application file for complete search history.

(56) References Cited

U.S. PATENT DOCUMENTS

| | | | | |
|---|---|---|---|---|
| 4,082,067 | A * | 4/1978 | Yanagihara | 239/87 |
| 5,758,826 | A | 6/1998 | Nines | |
| 5,915,626 | A | 6/1999 | Awarzamani et al. | |
| 6,109,543 | A * | 8/2000 | Bright et al. | 239/135 |
| 6,561,168 | B2 * | 5/2003 | Hokao et al. | 123/557 |
| 6,685,112 | B1 | 2/2004 | Hornby | |
| 6,889,671 | B2 * | 5/2005 | Rigney | 123/549 |
| 7,677,468 | B2 * | 3/2010 | Hornby et al. | 239/135 |
| 2007/0235557 | A1 | 10/2007 | Hornby | |
| 2009/0294552 | A1 * | 12/2009 | Trapasso et al. | 239/132 |
| 2010/0126471 | A1 * | 5/2010 | Cheiky et al. | 123/476 |

FOREIGN PATENT DOCUMENTS

JP 10238424 A * 9/1998

* cited by examiner

*Primary Examiner* — Len Tran
*Assistant Examiner* — James Hogan

(57) ABSTRACT

A fuel injector (10) includes an inlet tube (20). A valve body (12) is associated with the inlet tube to define a fuel passage (23). A valve seat (14) is associated with the valve body and defines an outlet opening (18). An armature (42) is movable with respect to the valve body between a first position and a second position. The armature is associated with a closure member (18) that opens and closes the outlet opening. An electromagnetic coil (40) is energizable to provide magnetic flux that moves the armature between the first and second positions to control fuel flow through the outlet opening. A heat exchanger (50) is provided in the inlet tube and a secondary coil (46) is energizable to provide a magnetic field to inductively heat the heat exchanger and thus fuel prior to exiting the outlet opening.

15 Claims, 2 Drawing Sheets

MULTI-POINT LOW PRESSURE INDUCTIVELY HEATED FUEL INJECTOR WITH HEAT EXCHANGER

FIELD

The invention relates to fuel injectors for vehicles and, more particularly, to a low pressure, heated fuel injector that adds thermal energy into the fuel prior to injection.

BACKGROUND

To reduce the dependency on mineral oil based fuels, there is currently a great deal of interest in renewable fuels. The present fuel of choice for spark ignition engines is ethanol or mixtures of gasoline and ethanol. Due to the vapor phase characteristics of ethanol, engines running on pure ethanol (E100) or mixtures of ethanol and water will not start below ambient temperatures of 15° C. to 20° C. In markets where mixtures of up to 85% ethanol and gasoline (E85) are legislated, the minimum start temperature is lower at −15° C. to −20° C. In the Brazilian market (E100) minimum required start temperatures are −5° C. to −10° C. and in Sweden and North America −30° C. to −40° C. are typical requirements. This invention addresses this cold temperature start dilemma by heating the injected fuel during start. For these applications, thermal energy must be added to the fuel prior to injection.

The current solution in Brazil (E100) is to have a small underhood gasoline tank and simple cold start injector and pump to inject gasoline into the intake manifold during cold start conditions. The disadvantages of this system include fuel aging during warm months causing a no start condition when the weather gets cold, a fire risk when filling the underhood tank with a hot engine, and the necessity of a second fuel. The current solution for E85 market is a winter blend fuel of E50 or E70 and in Sweden, a block heater. The disadvantages of these solutions include the use of these vehicles in markets were there is no block heater infrastructure, such as the rest of Europe or North America or in unexpectedly cold weather when the winter blend fuel is not available.

Heated fuel injectors have been developed to heat fuel prior to injection. For example, U.S. Patent Application Publication No. 2007/0235557A1 discloses an injector that inductively heats a valve body. In addition to the very rapid heat-up of the valve body facilitated by inductive heating, the advantage of this concept is that all the fuel of the first injection is heated. That is, there is no fuel between the heater and the valve. Among the disadvantages of this concept are limited surface area available for heating (only the inside cylindrical surface of the valve body), so in spite of the rapid temperature rise of the valve body, heat up times are long due to the lack of surface area limiting power input into the fluid. In addition, heavy modifications are required to existing manufacturing equipment to manufacture the configuration.

SUMMARY

There is a need to provide an improved fuel injector that adds thermal energy to fuel prior to injection, improves heat transfer efficiency, and reduces manufacturing costs.

An object of the present invention is to fulfill the need referred to above. In accordance with the principles of an embodiment, this objective is obtained by providing a fuel injector having an inlet tube defining an inlet of the fuel injector. A valve body is associated with the inlet tube to define a fuel passage through the fuel injector. A valve seat is associated with the valve body and includes an outlet opening in communication with the fuel passage. An armature is movable with respect to the valve body between a first position and a second position. The armature is associated with a closure member proximate the outlet opening and engaged with the valve seat when in the first position, and spaced from the valve seat when in the second position. An electromagnetic coil is energizable to provide magnetic flux that moves the armature between the first and second positions to control fuel flow through the outlet opening. A heat exchanger is provided in the inlet tube. A secondary coil is energizable to provide a magnetic field to inductively heat the heat exchanger and thus fuel prior to exiting the outlet opening.

In accordance with another aspect of an embodiment, a method of heating fuel prior to exiting a fuel injector provides a fuel injector having an electromagnetic coil energizable to provide magnetic flux that moves an armature between first and second positions to control fuel flow through an outlet opening of the fuel injector; a secondary coil; and a heat exchanger in an inlet tube. The secondary coil is energized to inductively heat the heat exchanger to heat fuel prior to exiting the outlet opening.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF AN EXAMPLE EMBODIMENT

Figure 1:
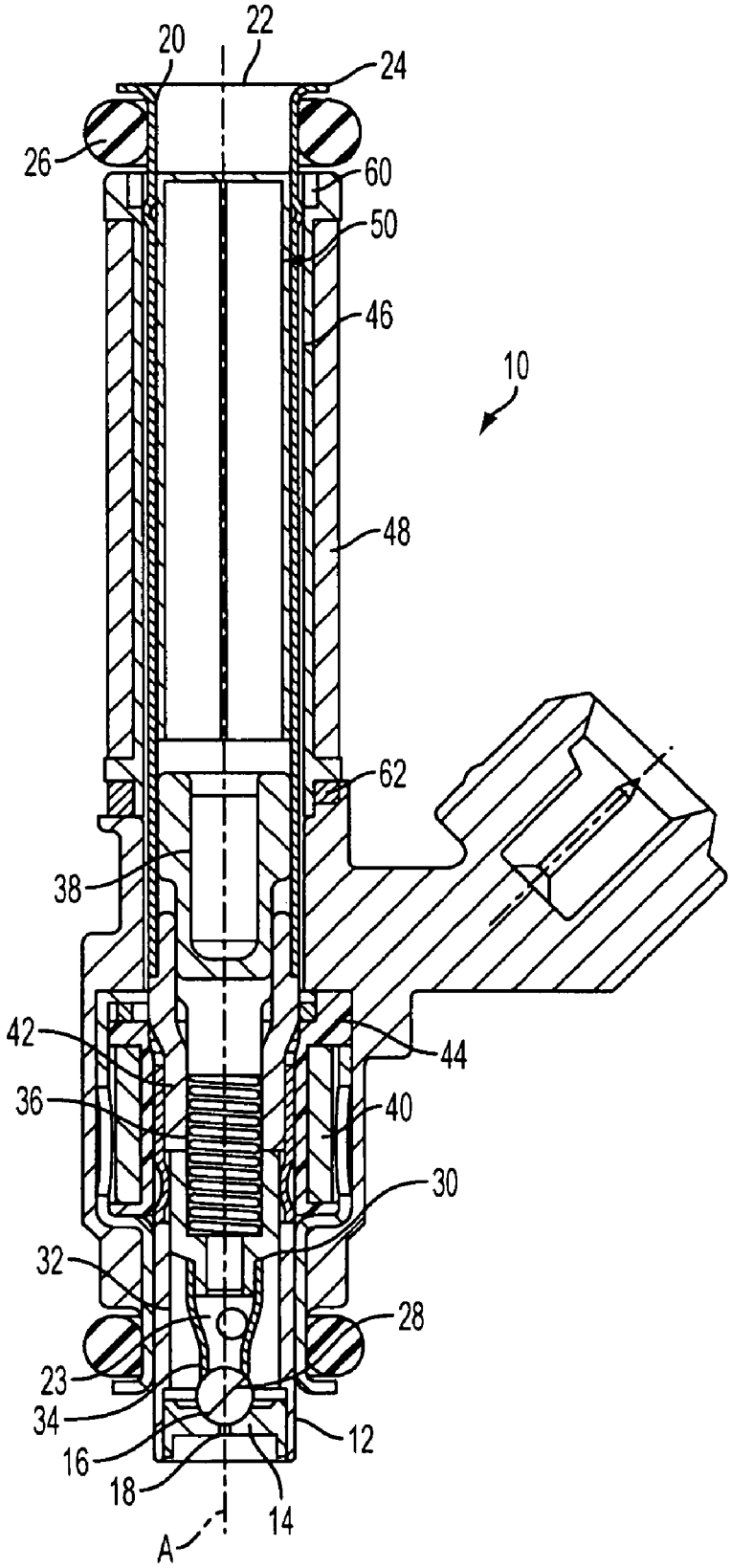
FIG. 1 is a sectional view of an inductively heated fuel injector in accordance with an embodiment of the present invention.

Referring to FIG. 1, a solenoid actuated fuel injector, generally indicated at 10, which can be of the so-called top feed type, supplies fuel to an internal combustion engine (not shown) of an automobile. The fuel injector 10 includes a valve body 12 extending along a longitudinal axis A. The valve body 12 includes a valve seat 14 defining a seating surface 16, which can have a frustoconical or concave shape, facing the interior of the valve body 12. The seating surface 16 includes a fuel outlet opening 18 centered on the axis A and in communication with an inlet tube 20 for conducting pressurized fuel into the valve body 12 to the seating surface 16. The inlet tube 20 defines an inlet end 22 of the injector 10 and has a retainer 24 for mounting the fuel injector 10 in a fuel rail (not shown) as is known. The inlet tube 20 is preferably of 300 series stainless steel and is non magnetic. The inlet tube 20 is associated with the valve body 12 to define a fuel passage 23 through the fuel injector 10. An O-ring 26 is used to seal the inlet end 22 in the fuel rail.

A closure member, e.g., a spherical valve ball 28, within the injector 10 is moveable between a first, seated, i.e., closed, position and a second, open position. In the closed position, the ball 28 is urged into engagement with the seating surface 16 to close the outlet opening 18 and prevent fuel flow. In the open position, the ball 28 is spaced from the seating surface 16 to allow fuel flow through the outlet opening 18.

An armature 30 that is axially moveable along axis A in a tube portion 32 of the valve body 12 includes valve ball capturing means 34 at an end proximate the seating surface 16. The valve ball capturing means 34 engages with the valve ball 28 outer surface adjacent the seating surface 16 and so that the valve ball 28 rests on the seating surface 16 in the closed position of the valve ball 28. A spring 36 biases the armature 30 and thus the valve ball 28 toward the closed position. A filter 38 is provided between the inlet end 22 and outlet opening 18 to filter fuel. The fuel passage 23 is such that fuel introduced into the inlet end 22 of the inlet tube 20 passes through the filter 38, over the valve ball 28, and through the outlet opening 18 when the valve ball 24 is in the open position. The valve body 12, armature 30, valve seat 14 and valve ball 28 define a valve group assembly such as disclosed in U.S. Pat. No. 6,685,112 B1, the contents of which is hereby incorporated herein by reference.

An electromagnetic coil 40 surrounds a pole piece or stator 42, formed of a ferromagnetic material, coupled to the inlet tube 20. The electromagnetic coil 40 is operable, in the conventional manner, to produce magnetic flux to draw the armature 30 away from the seating surface 16, thereby moving the valve ball 28 to the open position and allowing fuel to pass through the fuel outlet opening 18. Deactivation of the electromagnetic coil 40 allows the spring 36 to return the valve ball 28 to the closed position against the seating surface 16 and to align itself in the closed position, thereby closing the outlet opening 18 preventing passage of fuel. The electromagnetic coil 40 is DC operated and the coil 40 with bobbin 44, and stator 42 are preferably overmolded to define a power or coil subassembly such has disclosed in U.S. Pat. No. 6,685,112 B1.

Figure 2:
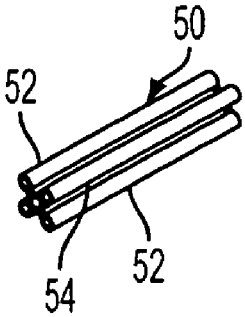
FIG. 2 is a perspective view of a heat exchanger of the fuel injector of FIG. 1, in accordance with an embodiment of the invention.
Figure 3:
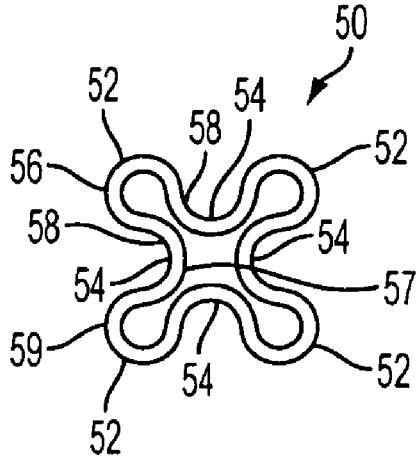
FIG. 3 is an end view of the heat exchanger of FIG. 2.

As shown in FIG. 1, a preferably plastic bobbin 46 is provided about at least a portion of the periphery of the inlet tube 20 and an inductive heating coil 48, as a secondary coil, is disposed about the bobbin 46. A heat exchanger, generally indicated at 50, is provided within the inlet tube 20. FIGS. 2 and 3 show an embodiment of a heat exchanger having a four-lobe configuration. More particularly, the heat exchanger 50 includes a plurality of folds defining a plurality of ridges or lobes 52 with a groove 54 between lobes 52 in a generally corrugated configuration. Due to this configuration, a surface area of the heat exchanger is advantageously increased as compared to a cylindrical structure. In the embodiment, on the periphery of the heat exchanger 50, an arc 56 of each outer lobe 52 joins an arc 58 of each groove 54. The heat exchanger 50 is in the form of a hollow, elongated tube, defining an internal surface 57 and an external surface 59. Thus, fuel can pass both the internal and external surfaces of the heat exchanger 50 with heat being transferred to the fuel.

The heat exchanger 50 is preferably of 400 series stainless steel and is magnetic. A flux washer 60, 62 is associated with each opposing end of the bobbin 46 to increase flux in the heat exchanger 50. Although a four lobe configuration is shown, it can be appreciated that to gain even more surface area, five or more lobes 52 and five or more grooves 54 can be provided.

When the coil 48 is energized, the magnetic field from the coil 48 inductively heats only the magnetic heat exchanger 50 (not the inlet tube 20) to preheat fuel in the inlet tube 20 prior to exiting the outlet opening 18 during operation of the fuel injector 10. Thus, the coil 48 and heat exchanger 50 can atomize fuel using inductive heating in the injector 10 where the liquid fuel is vaporized prior to exiting the outlet opening 18 for use during the cold start phase.

The injector 10 can be used for Flex Fuel Start applications to reduce emissions when E100 and E85 are the fuels used. The injector 10 enables efficient vehicle starts with E100 down to temperatures of −5 C with 200 W heating power even if flash boiling is interrupted. In conventional E100 applications as noted above, a vehicle will not start at 20 C and these applications require an additional gasoline tank as a start system.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the scope of the following claims.

What is claimed is:

1. A fuel injector comprising:

an inlet tube defining an inlet of the fuel injector;

a valve body associated with the inlet tube to define a fuel passage through the fuel injector;

a valve seat associated with the valve body, the valve seat including an outlet opening in communication with the fuel passage;

an armature movable with respect to the valve body between a first position and a second position, the armature being associated with a closure member proximate the outlet opening and engaged with the valve seat when in the first position, and spaced from the valve seat when in the second position;

an electromagnetic coil being energizable to provide magnetic flux that moves the armature between the first and second positions to control fuel flow through the outlet opening;

a heat exchanger in the inlet tube, the heat exchanger being in the form of a hollow, elongated tube defining an internal surface and an external surface such that during operation of the fuel injector, fuel flows past both of the internal and external surfaces, the tube being formed to a generally corrugated shape having a plurality of lobes, with a groove between lobes, the lobes and grooves defining both of the internal and external surfaces; and a secondary coil being energizable to provide a magnetic field to inductively heat only the heat exchanger of the injector and thus fuel prior to exiting the outlet opening.

2. The fuel injector of claim 1, wherein the inlet tube is non-magnetic and the heat exchanger is magnetic.

3. The fuel injector of claim 1, wherein the tube includes at least four lobes and at least four grooves.

4. The fuel injector of claim 1, wherein the secondary coil is wound on a bobbin of non-magnetic material, the bobbin being disposed about at least a portion of a periphery of the inlet tube.

5. The fuel injector of claim 4, wherein the bobbin has opposing ends, the fuel injector further comprising a flux washer associated with each end of the bobbin.

6. The fuel injector of claim 1, in combination with E85 or E100 fuel.

7. A fuel injector comprising:

an inlet tube defining an inlet of the fuel injector;

a valve body associated with the inlet tube to define a fuel passage through the fuel injector;

a valve seat associated with the valve body, the valve seat including an outlet opening in communication with the fuel passage;

an armature movable with respect to the valve body between a first position and a second position, the armature being associated with a closure member proximate the outlet opening and engaged with the valve seat when in the first position, and spaced from the valve seat when in the second position;

an electromagnetic coil being energizable to provide magnetic flux that moves the armature between the first and second positions to control fuel flow through the outlet opening;

means for exchanging heat disposed in the inlet tube, the means for exchanging heat being in the form of a hollow, elongated tube formed to define an internal surface and an external surface such that during operation of the fuel injector, fuel flows past both of the internal and external surfaces; and a secondary coil being energizable to provide a magnetic field to inductively heat only the means for exchanging heat of the injector and thus fuel prior to exiting the outlet opening.

8. The fuel injector of claim 7, wherein the inlet tube is non-magnetic and the means for exchanging heat is magnetic.

9. The fuel injector of claim 7, wherein the tube is formed to a generally corrugated shape having a plurality of lobes, with a groove between lobes, the lobes and grooves defining both of the internal and external surfaces.

10. The fuel injector of claim 9, wherein the tube includes at least four lobes and at least four grooves.

11. The fuel injector of claim 7, wherein the secondary coil is wound on a bobbin of non-magnetic material.

12. The fuel injector of claim 11, wherein the bobbin has opposing ends, the fuel injector further comprising a flux washer associated with each end of the bobbin.

13. The fuel injector of claim 7, in combination with E85 or E100 fuel.

14. A method of heating fuel prior to exiting a fuel injector, the method including:

providing fuel injector having an electromagnetic coil energizable to provide magnetic flux that moves an armature between first and second positions to control fuel flow through an outlet opening of the fuel injector; a secondary coil; and a heat exchanger in an inlet tube, the heat exchanger being in the form of a hollow, elongated tube defining an internal surface and an external surface such that during operation of the fuel injector, fuel flows past both of the internal and external surfaces, and wherein the tube is formed to a generally corrugated shape having a plurality of lobes, with a groove between lobes, the lobes and grooves defining both of the internal and external surfaces; and energizing the secondary coil to inductively heat only the heat exchanger of the injector to heat liquid fuel prior to exiting the outlet opening.

15. The method of claim 14, wherein the inlet tube is non-magnetic and the heat exchanger is magnetic, and wherein the step of energizing includes creating a magnetic field to inductively heat the heat exchanger and not the inlet tube.

* * * * *